US009968163B2

(12) United States Patent
Kamakeeaina et al.

(10) Patent No.: US 9,968,163 B2
(45) Date of Patent: May 15, 2018

(54) UNITARY MULTI-USE ALIGNMENT FIXTURE FOR SHOE PRODUCTION

(71) Applicant: NIKE, Inc., Beaverton, OR (US)

(72) Inventors: Tricia Kamakeeaina, Beaverton, OR (US); Jeremy Petty, Portland, OR (US); Eric Graham, Hillsboro, OR (US); Melody Crisp, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 722 days.

(21) Appl. No.: 14/490,885

(22) Filed: Sep. 19, 2014

(65) Prior Publication Data

US 2015/0000052 A1 Jan. 1, 2015

Related U.S. Application Data

(62) Division of application No. 13/122,706, filed as application No. PCT/US2009/058633 on Sep. 28, 2009, now Pat. No. 8,850,678.

(Continued)

(51) Int. Cl.
*B25B 27/14* (2006.01)
*A43D 8/00* (2006.01)

(Continued)

(52) U.S. Cl.
CPC ..... *A43D 8/00* (2013.01); *A43D 8/06* (2013.01); *A43D 8/20* (2013.01); *A43D 117/00* (2013.01);

(Continued)

(58) Field of Classification Search
CPC ..... B25B 11/00; B25B 11/02
See application file for complete search history.

(56) References Cited

U.S. PATENT DOCUMENTS 2,027,027 A 1/1936 Dopp
3,005,217 A 10/1961 Johnston (Continued)

FOREIGN PATENT DOCUMENTS

CN 1432336 7/2003
EP 0780065 A1 6/1997

(Continued)

OTHER PUBLICATIONS

European Office Action dated Mar. 21, 2016 in European Patent Application No. 09816998.0, 6 pages.

(Continued)

*Primary Examiner* — Lee D Wilson
(74) *Attorney, Agent, or Firm* — Shook, Hardy and Bacon LLP

(57) ABSTRACT

A system for manufacturing shoes is provided that includes two or more pieces of equipment used in the customization and manufacturing of shoes and an alignment fixture that may engage with each piece of equipment by way of an alignment mounting member. The alignment fixture may secure to it a portion of a shoe, such as an upper portion, wherein the shoe portion remains in a flat position, and in a fixed relationship to the alignment fixture, throughout the various processes performed by the pieces of equipment. These processes may include, for example, printing, laser, embroidery, forming, cutting, or the like.

9 Claims, 11 Drawing Sheets

Related U.S. Application Data

(60) Provisional application No. 61/194,300, filed on Sep. 26, 2008.

(51) Int. Cl.

| | |
|---|---|
| ***A43D 117/00*** | (2006.01) |
| ***A43D 8/06*** | (2006.01) |
| ***A43D 8/20*** | (2006.01) |
| ***C14B 1/56*** | (2006.01) |

(52) U.S. Cl.

CPC ..... *C14B 1/56* (2013.01); *A43D 2200/00* (2013.01); *D10B 2501/043* (2013.01); *Y10T 29/53913* (2015.01)

(56) References Cited

U.S. PATENT DOCUMENTS

| | | | | |
|---|---|---|---|---|
| 3,456,913 | A | 7/1969 | Lutz | |
| 3,562,930 | A | 2/1971 | Kaufman | |
| 3,857,129 | A | 12/1974 | Barre | |
| 4,072,461 | A | 2/1978 | Pirk | |
| 5,768,732 | A | 6/1998 | Blanc | |
| 5,827,459 | A | 10/1998 | Allen et al. | |
| 6,394,012 | B1 | 5/2002 | French et al. | |
| 7,311,302 | B1 * | 12/2007 | Farlow | H05K 13/0069 269/21 |
| 7,866,642 | B2 * | 1/2011 | McAllister | B23Q 1/035 269/266 |
| 8,109,493 | B2 * | 2/2012 | Koskovich | B27F 7/155 269/37 |
| 8,201,813 | B2 | 6/2012 | Maciejewski et al. | |
| 8,393,605 | B2 | 3/2013 | Yang et al. | |
| 8,850,678 | B2 * | 10/2014 | Crisp | A43D 8/06 29/271 |
| 2006/0244190 | A1 * | 11/2006 | Erdmann | H05K 13/0069 269/266 |
| 2010/0276859 | A1 | 11/2010 | Maciejewski et al. | |
| 2011/0167604 | A1 | 7/2011 | Stewart et al. | |
| 2012/0272463 | A1 * | 11/2012 | Crisp | A43D 8/06 12/103 |

FOREIGN PATENT DOCUMENTS

| | | | |
|---|---|---|---|
| GB | 321795 | A | 11/1929 |
| GB | 2304531 | A | 3/1997 |

OTHER PUBLICATIONS

Non-Final Office Action dated Jan. 16, 2014 in U.S. Appl. No. 13/122,706, 7 pages.

Notice of Allowance dated Jun. 4, 2014 in U.S. Appl. No. 13/122,706, 7 pages.

Notice of Allowance dated Jul. 15, 2014 in U.S. Appl. No. 13/122,706, 4 pages.

Chinese Search Report dated Feb. 25, 2013 in Chinese Application No. 200980145798.6, 2 pages.

Chinese Office Action dated Mar. 5, 2013 in Chinese Application No. 200980145798.6, 3 pages.

International Search Report with Written Opinion dated Nov. 23, 2009 for Application No. PCT/US09/58633, 10 pages.

* cited by examiner

UNITARY MULTI-USE ALIGNMENT FIXTURE FOR SHOE PRODUCTION

CROSS-REFERENCE TO RELATED APPLICATIONS

This application claims the benefit of priority to U.S. patent application Ser. No. 13/122,706, filed Jul. 29, 2011, entitled "Unitary Multi-Use Alignment Fixture for Shoe Production," which claims priority to PCT Application No. PCT/US2009/058633, filed Sep. 28, 2009, which claims priority to U.S. Provisional Patent Application No. 61/194,300, filed Sep. 26, 2008, entitled "Unitary Multi-Use Alignment Fixture for Shoe Production," all of which are expressly incorporated by reference herein in their entirety.

BACKGROUND OF THE INVENTION

One skilled in the relevant art will appreciate that shoe manufacturing involves many processes, some of which are independent from each other, and others that are dependent on each other. Within each process comes variation from one shoe to another. Variation even exists as a shoe or a portion of a shoe is moved from one process to another based on, for example, the shoe portions not being aligned relative to one another, and relative to the machine performing the process. These processes may include, for example, printing, laser, embroidery, stitching, forming, and the like. Variation is likely to occur because operator interaction is required, and therefore skill and craftsmanship of the operator dictates the final result of a shoe portion, such as the upper portion of a shoe. Operator interaction may be involved within specific processes, such as those listed above, or even moving a shoe portion from one process to the next. Variation is inevitable when a certain amount of operator interaction is involved. Further, shoe manufacturing processes on the upper portion of a shoe, for example, typically occur when the upper portion has been shaped, or is three-dimensional, as opposed to being flat or two-dimensional. In some cases, this may decrease the efficiency of the customization, forming, and stitching of the upper portion.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention is directed toward an alignment fixture that may be used to substantially remove variation in a shoe manufacturing process by minimizing operation interaction with the shoe or shoe portions, thus providing for the ability to predict the quality of shoe portions after each process has been performed. More particularly, the alignment fixture may be used in the shoe manufacturing process to move portions of a shoe through various processes, such as printing, laser, and embroidery, in addition to any other customization processes that may take place. Further, once customization has been completed, the alignment fixture may move the shoe portion to processes such as forming, stitching, and final trimming. The alignment fixture has a significant advantage in that it keeps the shoe portion completely flat throughout the processes mentioned above, which also allows for minimal operator interaction.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
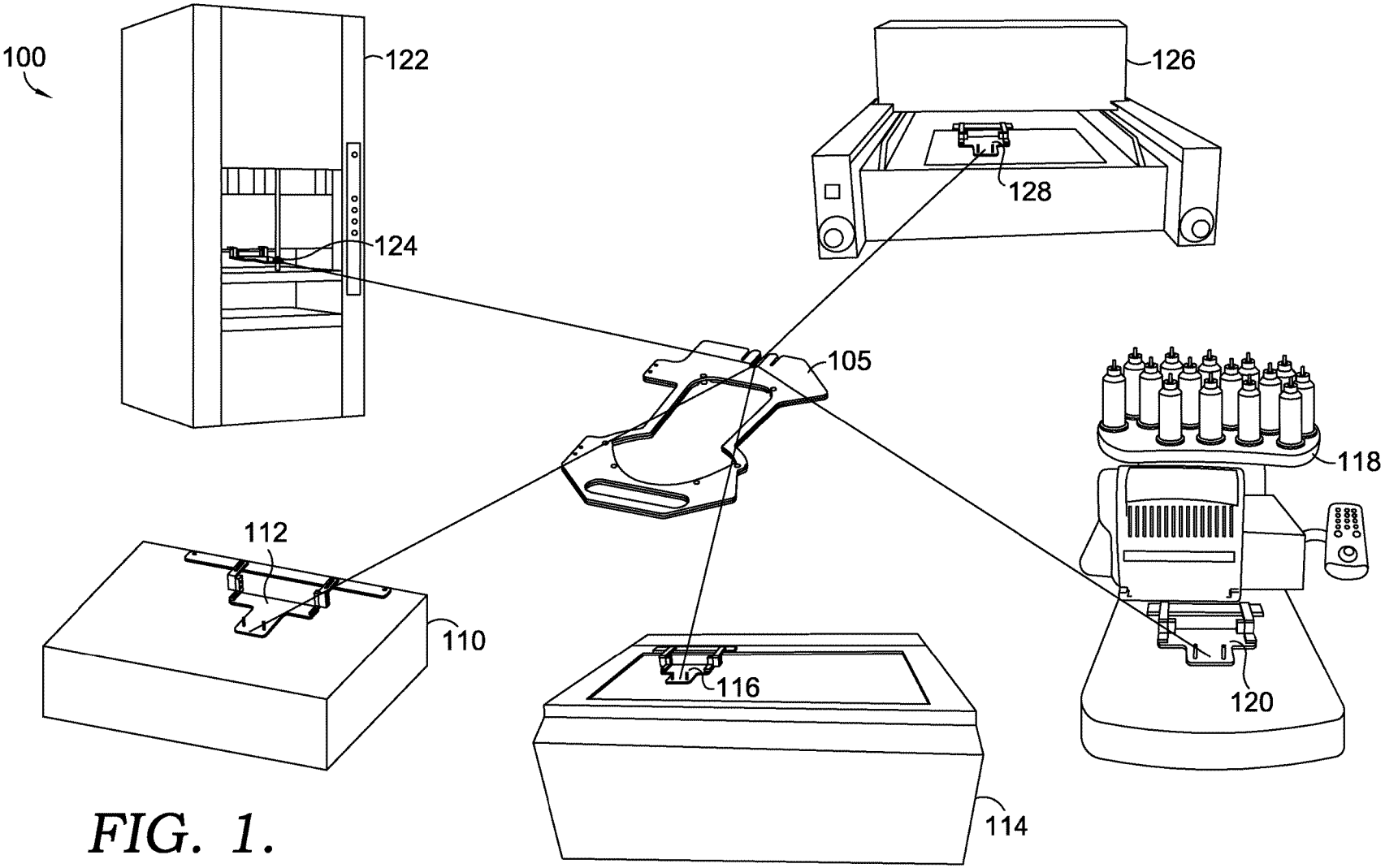
FIG. 1 illustrates a system for manufacturing shoes including a plurality of pieces of manufacturing equipment and an alignment gauge that can be mounted to each of the individual pieces of manufacturing equipment.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Embodiments of the invention provide for an alignment fixture that may be used to align and stabilize various portions of a shoe during a shoe manufacturing process, ensuring that the finished product is reproducible, thus substantially eliminating variation in the finished product. In one instance, a manufacturing process may, in some embodiments, include the individual manufacture of an outsole, a midsole, and an upper portion that, when combined, form a completed shoe. The alignment fixture, in one embodiment, may be used in the manufacture of the upper portion of a shoe, and more particularly, may be used to move the upper portion between various processes that are performed. By way of example only and not limitation, the alignment fixture may be utilized during processes such as printing, laser, embroidery, and other customization processes. Additionally, the alignment fixture may be used in forming and stitching of the upper portion of a shoe, which may take place after customization is complete.

As stated above, the alignment fixture may be used to substantially eliminate variation in the shoe manufacturing process by minimizing operator interaction in conjunction with the customization, forming, and stitching of the upper portion of a shoe. Ultimately, this may allow for the prediction of the quality of the shoe portions as the portions move from station to station in the overall manufacturing process. In addition, the alignment fixture allows for the upper portion of a shoe to remain in a flat, or two-dimensional position throughout many processes, such as, but not limited to, laser, embroidery, forming, and stitching.

Further embodiments of the present invention provide for the alignment and securement of the alignment fixture, having between it a shoe portion, to a particular piece of manufacturing equipment. Examples of the equipment that may be used will be described below, but may include, for instance, a printer, a laser machine, an embroidery machine, a forming machine (e.g., a heat press), and a cutting machine. More specifically, the shoe portion may remain secured to the alignment fixture while it moves from one process to another such that the shoe portion is consistently and accurately aligned to the alignment gauge throughout various processes performed to the shoe portion. Additionally, the alignment gauge may be secured or engaged with each piece of equipment by way of an alignment securing mechanism such that the alignment fixture may be easily secured and removed from each piece of equipment as the processes performed on the shoe progress. In order for these processes to be performed accurately, thus removing a substantial amount of variation in the shoe manufacturing and customization process, a mounting member associated with the alignment gauge may assist in engaging the alignment gauge to the alignment securing mechanism, and thus to the piece of equipment for which the alignment securing mechanism is secured. In the end, this mounting and securement structure ensures a fixed relationship between a shoe portion and each piece of equipment.

It will become apparent that the alignment fixture described herein is used throughout many processes wherein the portion of the shoe is kept in a flat position. The alignment fixture possesses several features that ensure true flexibility of the processes used while the flat portion of the shoe (e.g., tongue, vamp) is held within the frames, and further allowing other processes other than those described herein to be used in conjunction with the alignment fixture. For example, one feature is that in many embodiments, the shape of the frame or plate is such that it fits around a tool that can be used for forming, for example. As such, the shape of the plate and the forming tool may be similar or even identical. These portions of the alignment fixture may be shaped based upon the portion of the shoe that is being used with the alignment fixture. Another feature is the mounting mechanism that is described below. This mounting mechanism allows the alignment fixture to, in one embodiment, snap into place on various machines, such as an embroidery or final trim machine. Further, another feature is the alignment pins on various machines, such as a welding and a cutting machine that align with corresponding holes in the plates.

An alignment fixture is described herein that is used to perform a method for implementing a manufacturing process on a portion of a shoe that is secured to the alignment fixture. In one embodiment, this method includes securing a shoe portion between a first portion and a second portion of an alignment fixture such that the shoe portion is substantially flat. Further, it includes engaging an alignment mating member corresponding to the alignment fixture with an alignment mounting member corresponding to a first piece of manufacturing equipment. The method additionally includes performing one or more manufacturing processes on the shoe portion, wherein the shoe portion remains flat and in a fixed relationship to the alignment fixture throughout the one or more manufacturing processes.

Referring to the drawings in general, and initially to FIG. 1, a system 100 for manufacturing shoes is illustrated, and includes a plurality of pieces of manufacturing equipment and a corresponding alignment gauge 105 that, in some embodiments, may be secured to each piece of equipment during a particular shoe manufacturing process. In the manufacturing system according to the present invention, the system may include several pieces of manufacturing equipment, as illustrated in FIG. 1. It should be noted that while certain pieces of manufacturing equipment are illustrated in FIG. 1, these are shown as just one possible assembly. Other types of equipment that perform other functions with respect to a shoe portion may also be used in conjunction with the alignment gauge 105. In addition, not all of the pieces of equipment shown may be used in conjunction with the alignment gauge 105. FIG. 1 is merely an exemplary embodiment of types of equipment that could be used with the alignment gauge 105.

As mentioned, the embodiment of FIG. 1 includes a plurality of pieces of manufacturing equipment that may, in one embodiment, sequentially perform various operations or processes to the shoe portion. The processes, in another embodiment may be performed in a non-subsequential manner. One such assembly of manufacturing equipment, as shown in FIG. 1, may initially include a printer 110 whose input may include white goods (e.g., synthetic leather, leather, mesh), or even goods that have already been through a preliminary print. The printer 110 may print directly onto the white goods while a portion of the white goods is fitted into the alignment gauge 105. In another embodiment, however, the printing process or other printing processes may occur prior to or even after the shoe material has been fitted into the alignment gauge 105. In some instances of the present invention, the printer 110 may not only print colors onto the white goods, but may also print outlines for holes where the shoe portion is to be pinned to the alignment gauge, and other components if applicable. This allows the operator to accurately pin or secure the shoe portion into place relative to the alignment gauge 105 thus allowing for the alignment gauge 105 to be aligned and secured relative to each piece of equipment with which it is used. Some holes that are printed may be printed differently than other holes, such as having a double circular line instead of a single circular line surrounding the hole. These holes may register with a cutting machine that is used to cut the holes in the locations provided by the printer.

The printer 110 is secured to an alignment mounting member 112 that is then secured directly or indirectly to the alignment gauge 105. Also illustrated in FIG. 1 is a second piece of manufacturing equipment, a laser machine 114. The alignment gauge 105 may also be designed and manufactured such that the alignment gauge can attach directly to the laser machine 114 by way of an alignment mounting member 116 that aligns the alignment gauge 105 to the alignment mounting member, and therefore the particular piece of equipment. The alignment mounting member 116, being secured to the alignment gauge 105, allows for the shoe portion to be positioned in a manner such that the precision of the laser process drastically increases compared to traditional laser processes performed on shoe portions.

With continued reference to FIG. 1, another piece of manufacturing equipment, an embroidery machine is shown generally as item 118, and may embroider at least a portion of the shoe material once the alignment gauge 105 has been attached or secured to it. The embroidery machine 118 may have secured to it an alignment mounting member 120 that, like that described above, acts to both align the alignment gauge 105 to the embroidery machine 118, and also mounts one to the other. Next, a heat press 122 is illustrated, which presses together two pieces of material after various other materials have been placed in between them, such as, for example, foam, which may be used not only for the tongue of a shoe, but also for other shoe portions. The heat press also may have an alignment mounting member 124. The next piece of equipment may be a cutting machine 126 that cuts the shoe portion into its intended size and shape. To ensure that the shoe portion is cut substantially similar to its intended shape and size, the alignment gauge 105 may be secured to the cutting machine 126 by way of an alignment mounting member, shown here as item 128.

Figure 2:
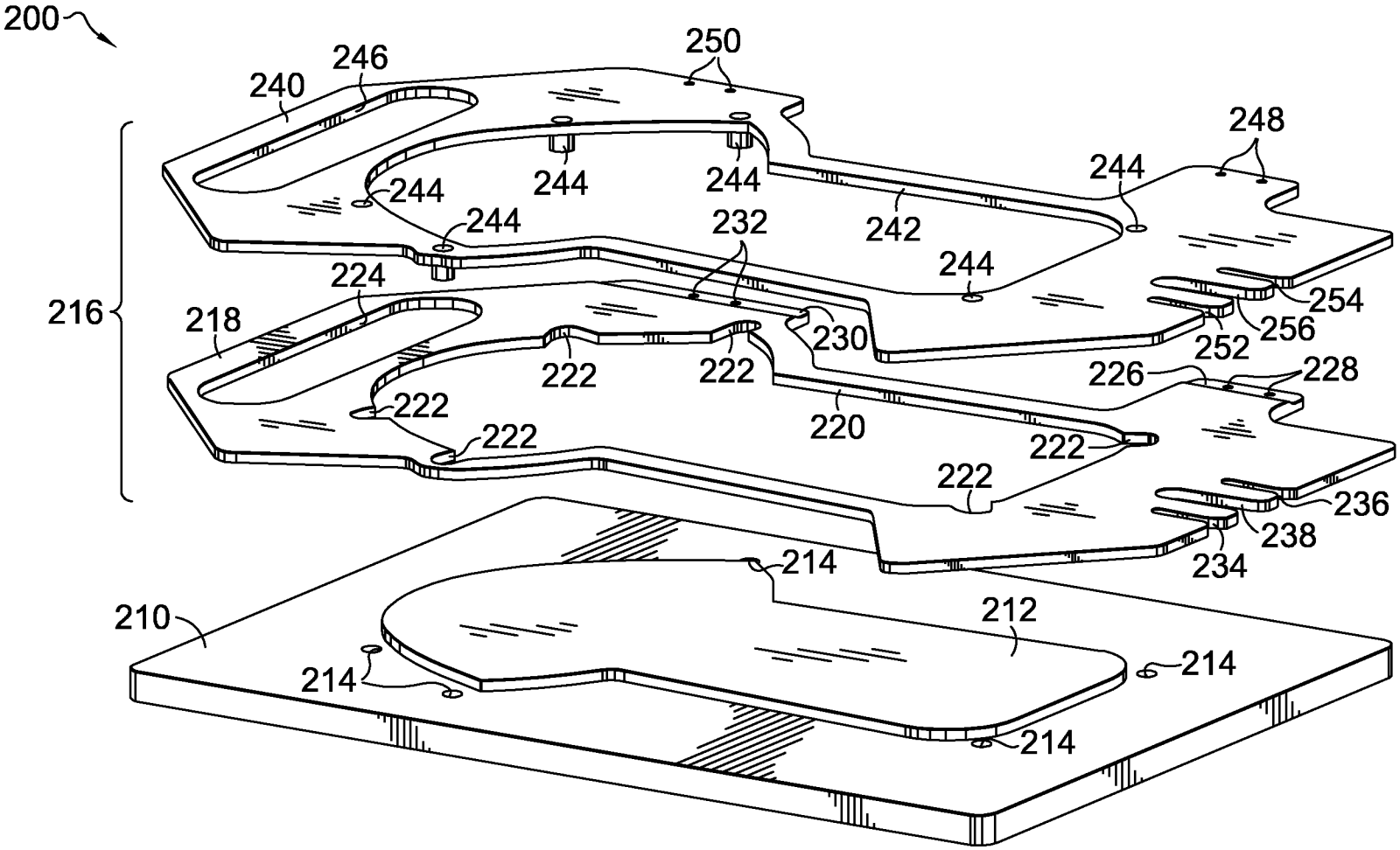
FIG. 2 illustrates a perspective view of an alignment fixture for aligning and stabilizing a shoe portion throughout a shoe customization process, in accordance with an embodiment of the present invention.
Figure 3:
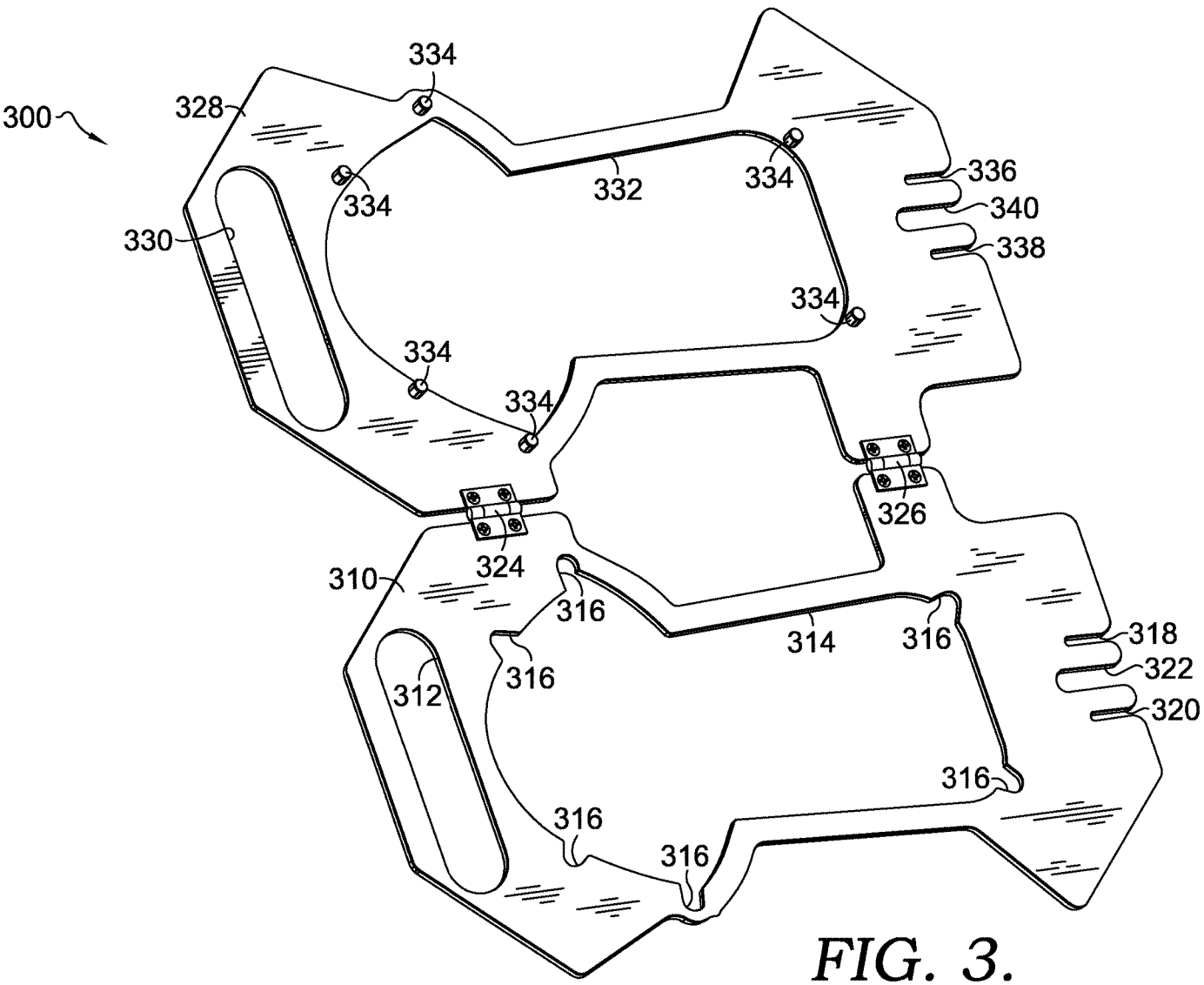
FIG. 3 illustrates an enlarged perspective view of an alignment gauge comprising a first plate and a second plate between which a shoe portion is secured, in accordance with an embodiment of the present invention.
Figure 5:
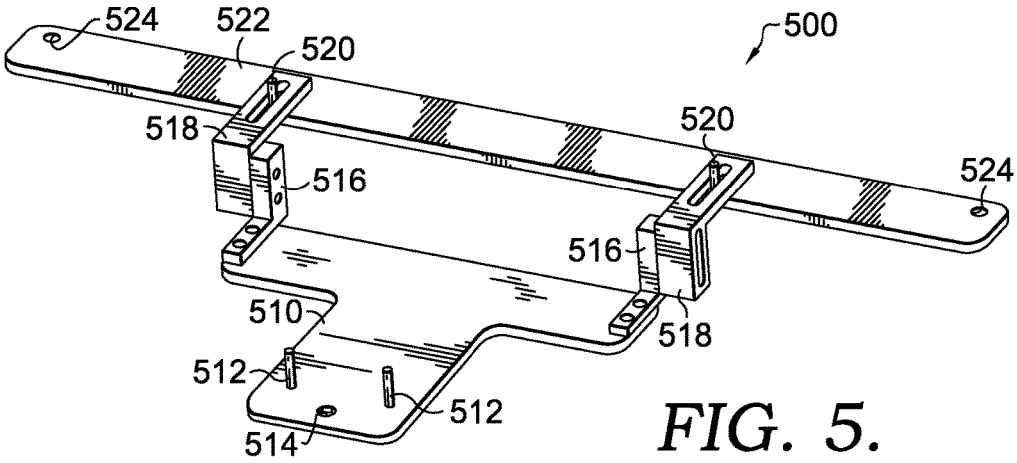
FIG. 5 illustrates an enlarged perspective view of an alignment mounting member that may be secured to an alignment gauge, in accordance with an embodiment of the present invention.
Figure 6:
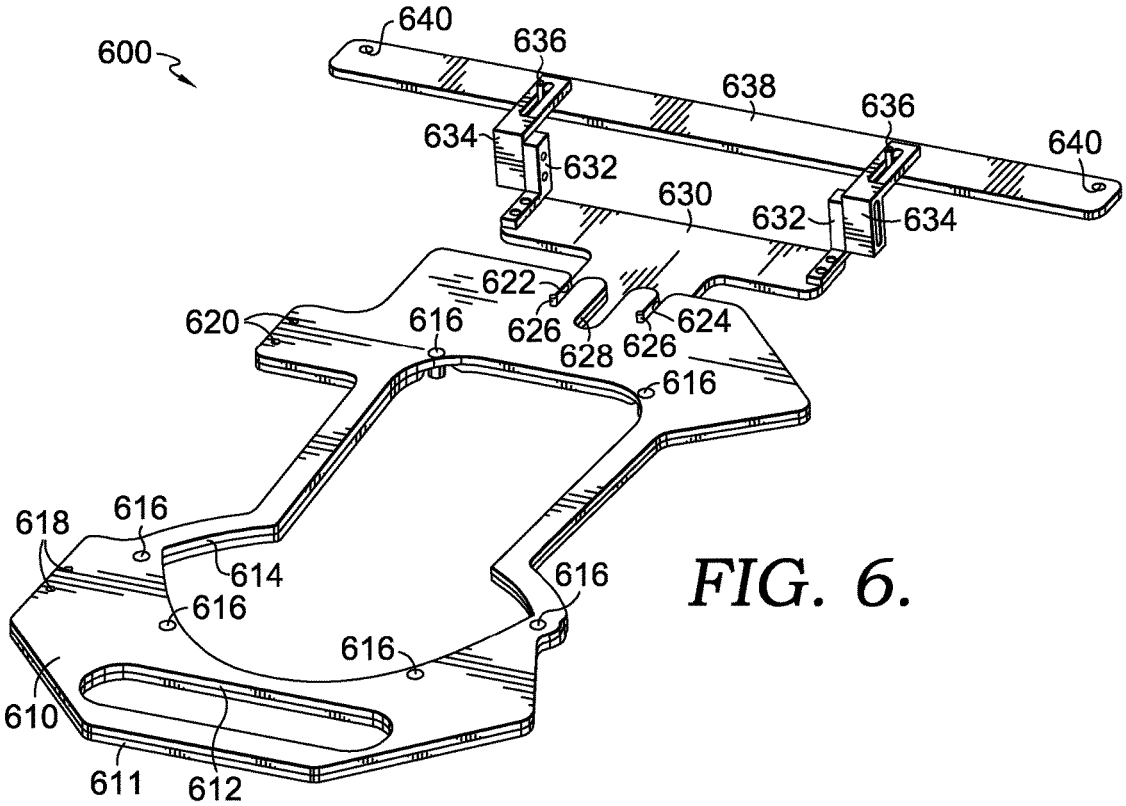
FIG. 6 illustrates a perspective view of an alignment mounting member secured to an alignment gauge for use in a shoe manufacturing process, in accordance with an embodiment of the present invention.

According to another aspect of the present invention, the alignment gauge 105 may be secured to alignment mounting members, such as 112, 116, 120, 124, and 128 in a number of ways. A more detailed rendering of the alignment gauge 105 is shown in FIGS. 2 and 3. Further, a more detailed rendering of the alignment mounting member is shown in FIG. 5. An exemplary connection of the alignment gauge 105 to an alignment mounting member is shown in FIG. 6, although the connection or securing mechanism shown in FIG. 6 is but one example as to how the alignment gauge 105 may be connected to the alignment mounting member. In the exemplary embodiment of FIG. 6, the alignment gauge comprises two small slots and a larger slot (e.g., alignment slots), which, together, may be termed a mating member, as it corresponds and mates with a portion of the alignment mounting member, as will be more fully described below. The alignment mounting member 500, as detailed in FIG. 5, comprises two upwardly extending pins 512, which slide into (e.g., mate with), or engage with, each of the corresponding small slots on the alignment gauge, which aligns and secures the alignment gauge, and in particular the mating member, to the alignment mounting member.

While the securing mechanism between the alignment gauge and the alignment mounting member has been described as a series of slots that receive or engage with two upward extending pins, the securing mechanism may be implemented in any other suitable mechanical configuration, such as, but not limited to one or more pegs (e.g., square and/or round) that engage with one or more corresponding holes in the alignment gauge, or even posts that extend downward from the alignment gauge, or more specifically from the mating member, that engage with a portion of the alignment mounting member.

Referring now to FIG. 2, a perspective view of an alignment fixture used for aligning and stabilizing a portion of a shoe throughout at least a portion of a shoe manufacturing process is shown in accordance with an embodiment of the present invention. It will be appreciated that alignment fixtures that provide the functionality provided herein may be made in many shapes and sizes, and may include a different number of components, such as plates, as is shown in the embodiment of FIG. 2. Thus FIG. 2 is merely provided as an example of one formation of an alignment fixture. For example, the alignment fixture 200 may be used for a certain portion of a shoe, and even for a certain process, such as a customization process, forming, stitching, or the like. Here, the alignment fixture 200 may be specifically used for a tongue of a shoe, and even more particularly, may be used for aligning the tongue portion during a laser process, which provides for customization of the tongue. Even more specifically, the alignment fixture 200 may be used for a tongue portion of a skate shoe. Alignment fixtures may take on a variety of shapes depending on the specific type of shoe and shoe portion that is being customized, formed, and stitched.

Initially, one portion of the alignment fixture 200 shown in FIG. 2 is a base plate 210 that is positioned on the bottom of the alignment fixture 200. The base plate 210 helps to hold a shoe portion in place so that it doesn't move throughout various processes. The base plate 210 includes a raised portion 212 and a plurality of base plate holes 214. The raised portion 212, when secured to the other portions of the alignment fixture, fits through the other portions with the shoe portion laying in a substantially flat position on top of the raised portion 212. The shape of the raised portion 212 is dependent upon the type of shoe portion and the type of shoe currently being customized, formed, or stitched. The base plate holes 214 are designed for the insertion of pins, which will be described in more detail below. The pins hold the entire alignment fixture 200 together, as will become apparent. FIG. 2 illustrates that the base plate 210 has six base plate holes 214 (although only five are visible), but it will be that any number of holes, and therefore pins, may be used, as long as the functionality of holding the alignment fixture together is met.

With continued reference to FIG. 2, item 216 is an alignment gauge, which in the embodiment of FIG. 2, comprises two alignment plates that may be connected by a securing mechanism (e.g., hinge). In some embodiments, less than or more than two alignment plates may be used to provide the same functionality as the alignment gauge shown in FIG. 2 having two plates. The two plates include a first plate 218 and a second plate 240. Depending on the process, shoe type, shoe portion, etc., the first plate 218 may be located above the second plate 240, or the second plate 240 may be located above the first plate 218. The first plate 218 and the second plate 240, in some embodiments, may have similar features and may even look substantially similar in many ways. The first plate 218 has a framed center portion 220, or a cutout area, that has a plurality of notches 222, which act as a placement guide for pins. The shape of the framed center portion 220 may be dictated by the shoe portion utilizing the alignment gauge 216. For instance, because the alignment gauge 216 illustrated in FIG. 2 is to be used for a shoe tongue, and specifically a skate shoe tongue, the shape of the framed center portion 220 of the first plate 218 is shaped to hold a skate shoe tongue. Other shapes of the framed center portion 220 are contemplated to be within the scope of the present invention, such as a shape appropriate for a quarter, a vamp, a heel, and even various portions or components of these shoe parts.

Continuing with reference to FIG. 2, the first plate 218 has a first plate handle 224 that allows for easy and efficient loading and removal of the alignment gauge 216 onto other components, such as base plate 210. As previously mentioned, the first plate 218 may be secured or connected to the second plate 240, and this may be done by way of a hinge, in one embodiment. Hinge 226 includes two hinge holes 228, and hinge 230 includes two hinge holes 232. Further, depending on which process is using the alignment gauge 216 at a particular time, the alignment gauge 216 may be connected to an alignment mounting member, which will be described below. In order to secure the alignment fixture to a mounting device, the first plate has two small slots 234 and 236, and a large slot 238. Other securement arrangements are contemplated to be within the scope of the present invention.

The second plate 240, as previously mentioned, may have features similar to those of the first plate. The second plate 240 also has a framed center portion 242 that is shaped according to the shoe portion using the alignment gauge. Here, a skate shoe tongue is the shoe portion, and thus the framed center portion 242 is shaped accordingly. The framed center portion 242 of the second plate 240, in one embodiment, may be the exact size and shape of the framed center portion 220 of the first plate 218, with the exception of the notches 222 of the first plate 218. The second plate 240 has a plurality of pins 244 that may be inserted through the notches 222 and protrude down through the base plate holes 214 in order to secure each plate in place and also secure the shoe portion to the alignment fixture 200. Here, six pins 244 are shown in FIG. 2, but it will be understood that any number of pins may be used to secure the device. The pins 244 may be any type of pin, such as a dowel pin, but may also be a screw, a bolt, a nail, or any other suitable or desired fastening means. The second plate 240 also has a second plate handle 246, similar to the first plate handle 224. These handles may even be the exact same size and dimension, in one embodiment.

As mentioned, the first plate 218 may include one or more hinges to secure it to the second plate 240. The second plate 240 has a first hinge portion having two holes 248, and a second hinge portion also having two holes 250. Further, in order to facilitate a connection of the alignment gauge to a mounting device, which may be used in certain processes, the second plate 240 has similar slots to the first plate 218, which here, include two small slots 252 and 254, and a large slot 256. The slots slide into a portion of a mounting device to provide a secure fit. It should be noted that when the shoe portion is placed between the first plate 218 and the second plate 240, which is subsequently placed onto the base plate 210 and specifically onto the raised portion 212, the top of the raised portion 212, or the shoe portion may be flush with the top of the second plate 240, in one embodiment, allowing for easy access in the various processes with which the alignment fixture is used.

Referring now to FIG. 3, an alignment gauge 300 is shown with a first plate 310 hinged to a second plate 328. In other embodiments, the two plates may be secured to each other by other methods other than being hinged. In yet other embodiment, the two plates may not be secured to each other at all. Further, in still other embodiments, a single plate may be used, and will be described in more detail herein. The alignment gauge 300 is the identical alignment figure described in FIG. 2, but is shown in more detail, and is shown in a hinged position. Initially, a portion of a shoe is inserted between the first plate 310 and the second plate 328 so that the shoe portion may be secured in place. In the embodiment of FIG. 3, the shoe portion may be a skate shoe tongue. The first plate 310 includes a first plate handle 312 and a framed center portion 314. Again, the framed center portion 314 may be sized according to the type of shoe, portion of shoe, and shoe size. There are a plurality of notches 316 that allow for the securing of a shoe portion using pins, as will be described in more detail below. As previously described, in order to provide the alignment gauge to be secured to an alignment mounting member, two small slots 318 and 320 and a large slot 322 are provided to allow a portion of an alignment mounting member to slide into the slots 318, 320, and 322. Two hinges 324 and 326 are illustrated, which connect the first plate 310 to the second plate 328.

The second plate 328 has some features similar to those of the first plate 310. For example, the second plate 328 has a second plate handle 330 that may be the same shape as the first plate handle 312 located on the first plate 310. The second plate also has a framed center portion 332 that is cut out and that is substantially the same shape as the framed center portion 314, with the exception of the notches 316 present in the first plate 310. Further, the second plate 328 has a plurality of pins 334 that are inserted through the notches 316. The pins 334 may be dowel pins in one embodiment, but may be any type of securing or fastening device such as, but not limited to a screw, nail, bolt, etc. The second plate 328 additionally has two small slots 336 and 338, and a large slot 340 for securing the alignment gauge to an alignment mounting member.

Figure 4:
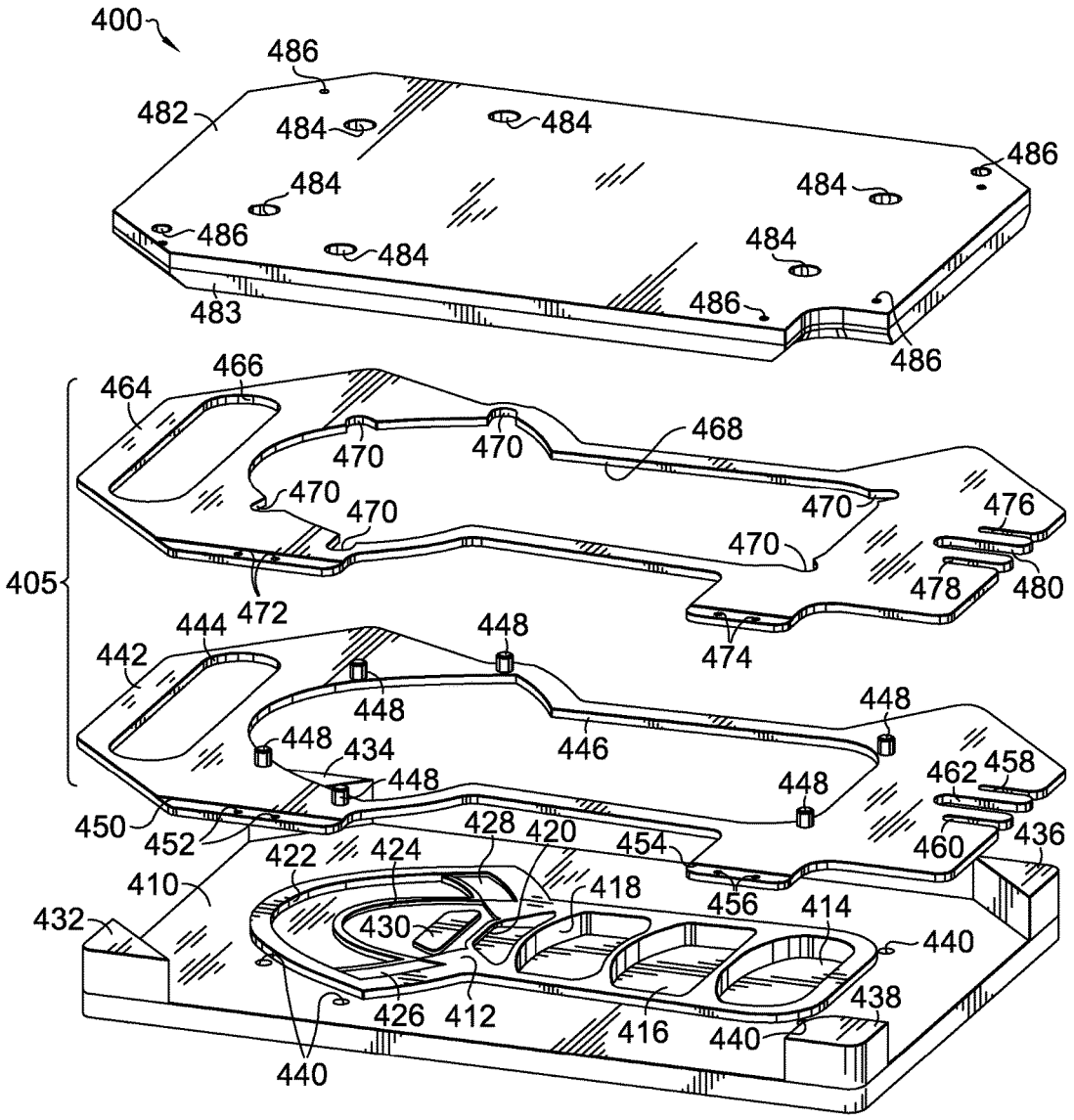
FIG. 4 illustrates a perspective view of an alignment fixture for use in forming a shoe portion, in accordance with an embodiment of the present invention.

Turning now to FIG. 4, a perspective view of an alignment fixture is shown for use in forming a shoe portion, in accordance with an embodiment of the present invention. Initially, it should be noted that the alignment gauge 405 illustrated in FIG. 4 may be the same alignment gauge illustrated in FIG. 2, as well as FIG. 3. FIG. 2 illustrates the alignment gauge 216 being used in a laser process, but as mentioned, the alignment gauge is used for many other processes as well. Here, in the embodiment of FIG. 4, the alignment gauge 405 may be used as a component in an alignment fixture 400 in a forming process. It should be noted that while various components are illustrated in FIG. 4 as contributing to the alignment fixture 400, it is contemplated to be within the scope of the present invention that any number of components may be used to accomplish the functionality of the alignment fixture 400, as set forth below.

A base plate 410 is shown as the bottommost plate or component in the alignment fixture 400. The base plate 410, like the base plate 210 of FIG. 2, includes a raised area 412 that assists in forming the shoe portion. Here, like the shoe portions described with respect to FIG. 2 and FIG. 3, the shoe portion used with the alignment fixture 400 of FIG. 4 may also be a skate shoe tongue, as indicated by the shape of the components. Here, though, the alignment gauge 405 is used with other components for forming the tongue. The raised area 412 includes several recessed areas including recessed areas 414, 416, 418, 420, 422, 424, 426, 428, and a raised area 430 within the raised area 412. The number and shape of these recessed areas and raised areas are dictated by the design of a particular shoe type or model, and also based on the final shape that the shoe portion, which here is the tongue of a skate shoe, will take. In some embodiments, the recessed portions such as 414, 416, 418, 420, 422, 424, 426, 428, etc., may be filled with foam or another material that may be forced or pushed into the shoe portion.

To facilitate an easy and efficient assembly of the alignment fixture 400, the base plate 410 has three generally triangular raised portions 432, 434, and 436 on three corners of the base plate 410, and one corner of the base plate 410 has a generally rectangular or even square shaped raised portion 438. Because three of the four corners are the same shape and the fourth corner is a different shape, there may be only one way to fit the alignment fixture 400 together, as will become apparent with further discussion below. Although the raised portions 432, 434, and 436 are shown as a generally triangular shape, these may be any other shape, and are shown here for exemplary purposes only. The same holds true for the raised portion 438. Finally, the base plate 410 includes a plurality of base plate holes 440 for insertion of a securing mechanism (e.g., dowel pin, screw, nail, bolt), which holds the various plates of the alignment fixture 400 together.

The first plate 442 includes a first plate handle 444 that is cut out from the first plate 442 to allow for easy and efficient assembly and disassembly of the alignment fixture 400. A framed center portion 446 is shaped to hold a skate shoe tongue, and as mentioned, the shape and size of this framed center portion 446 will vary depending on the shoe portion, type of shoe, shoe size, etc. The first plate 442 has a plurality of pins 448 (six pins 448 shown) that assist in securing the alignment gauge 405 to a top plate 482, discussed further below. The first plate 442 also has two hinges 450 and 454, each having holes 452 and 456 for connecting or securing the first plate 442 to the second plate 464. Additionally, the first plate 442 has a plurality of slots, 458, 460, and 462, which allow for the securement of the alignment gauge 405 to an alignment mounting member, shown in FIGS. 5 and 6.

With continued reference to FIG. 4, the second plate 464 may have several features similar to those of the first plate 442. For instance, the second plate 464 has a second plate handle 466 that may be the same size and shape as the first plate handle 444, and the two openings may be such that they align with each other when the first plate 442 and the second plate 464 are pressed together. The second plate 464 also has a framed center portion 468 that may be substantially the same shape as the framed center portion 446, with the exception of notches 470, allowing for alignment of the pins 448 and the notches 470. There are six notches 470 illustrated in FIG. 4, although it is contemplated to be within the scope of the present invention that more or less than six may be used to achieve the same functionality, which is to hold the shoe portion in place, and to attach the alignment gauge 405 to the other components of the alignment fixture 400. The second plate 464 also has holes 472 and 474 for securing the second plate 464 to the first plate 442 by, for example, a hinge, using the hinges 450 and 454 shown on the first plate 442. To facilitate the connection of the alignment gauge 405 to an alignment mounting member, for example, two small slots 476 and 478, and a large slot 480, are provided on the second plate 464 for sliding an alignment pin into the slots. Other arrangement of slots may be utilized to perform the same function, in addition to other mechanisms other than slots.

A top plate 482 is shown that attaches to the top of the alignment gauge 405. As shown, a second top plate 483 may also attached to the top plate 482, but in some embodiments, only one plate, such as the top plate 482 is used as the top component to the alignment fixture 400. Here, the top plate 482 includes a plurality of top plate holes 484, which may align with the notches 470, the pins 448, and the base plate holes 440 so that the pins may be inserted into the notches and holes. In one embodiment, the pins 448 extend through the notches 470, and through the top plate holes 484 such that each plate is secured in place. The top plate 482 also has a plurality of connection holes 486 that may be present if two top plates are used. If only one plate is used, such as the top plate 482, these connection holes 486 may not be necessary, as they may be used to connect the two top plates together.

Turning now to FIG. 5, an alignment mounting member 500 is illustrated that may be connected to an alignment gauge or other component of the alignment fixture and may be used to mount the alignment fixture to various pieces of equipment involved in the customization, forming, or stitching processes performed on various shoe portions. Initially, a base 510 has two upwardly extending pins 512 that slide into the slots described above that may be present on the first and second plates of the alignment gauge. The alignment mounting member 500 comprises a base hole 514 that may be used, in certain embodiments, as a secondary mounting mechanism for mounting the alignment mounting member to the alignment gauge. A first bracket 516 is shown on either side of the base 510 and is connected to the base by the two holes shown. The first bracket 516 is then connected to a second bracket 518, also shown on either side, by a securing or fastening device such as, for example, a pin, a bolt, a screw, a nail, or the like. A mounting plate 522 has two mounting pins 520 that extend through a framed portion of the second bracket 518 and is provided with two mounting holes 524 for mounting the alignment mounting member 500 to a particular piece of equipment, which performs various processes to the shoe portion. In particular, the alignment mounting member 500 shown here may be used to connect the alignment fixture to an embroidery machine, for example, or any other machine that may be used to manufacture or customize a shoe, as discussed above in regard to FIG. 1.

FIG. 6 illustrates the same alignment mounting member as described above in respect to FIG. 5, but illustrates the alignment mounting member attached to an alignment gauge. The alignment gauge may comprise a first plate 611 and a second plate 610, each of which includes a handle, shown together as item 612. The plates also have a framed center portion 614, which takes the shape of a tongue, and specifically a skate shoe tongue. The shape of the framed center portion 614, as previously described, may vary depending on the shoe portion being aligned and secured by the alignment gauge. A plurality of pins 616 are shown having been inserted or slid through a plurality of notches used to secure a shoe portion in between the two plates. This is detailed, for example, in FIG. 2. Further, the hinges 618 and 620 that are also detailed in FIGS. 3 and 4 are illustrated.

To facilitate connection of the alignment gauge to an alignment mounting member, small slots 622 and 624, and a large slot 628 are illustrated, collectively termed an alignment mating member, and allow for the insertion or sliding of upwardly extending pins 626 into the small slots 622 and 624. Base 630, in addition to having the two upwardly extending pins 626, also has a first bracket 632 on either side and a second bracket 634 on either side. The first bracket 632 is connected to the base, and the second bracket 634 is connected to the first bracket 632 by any type of securing mechanism, such as, for example, dowel pins, screws, nails, bolts, or the like. Mounting plate 638 has two pins 636 that slide into a cutout portion of the second bracket 634 for securing the mounting plate 638 to the rest of the alignment mounting member, and in turn, to the alignment gauge. Mounting holes 640 are shown that facilitate connection or attachment to a particular piece of equipment, such as an embroidery machine, for example. Other machines may include a printer, laser, stitching, forming, or the like.

Figure 7:
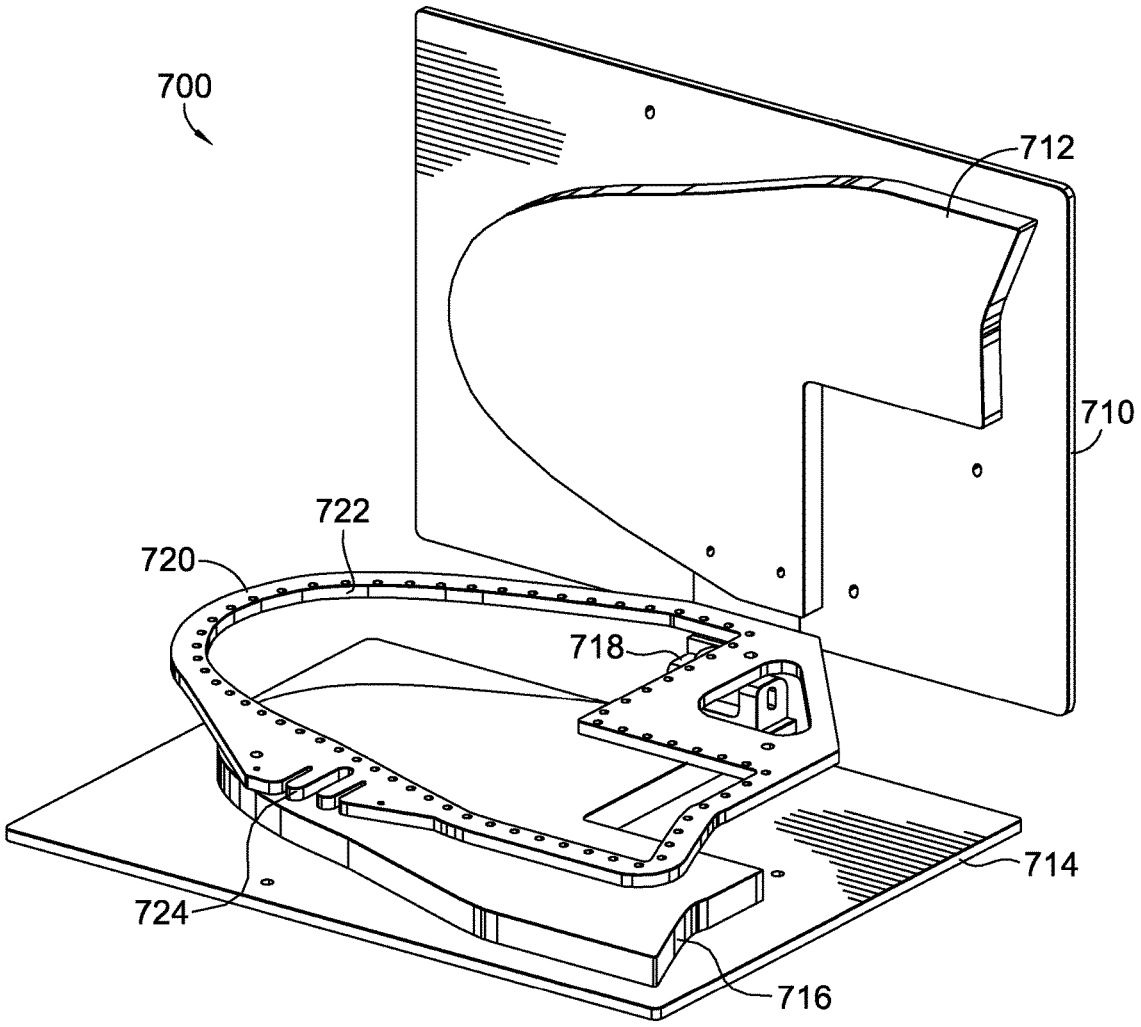
FIG. 7 illustrates an alignment fixture used to cold press a vamp portion of a shoe, in accordance with an embodiment of the present invention.

Turning now to FIG. 7, an alignment fixture 700 is shown, and is used to cold press a vamp portion of a shoe, in accordance with an embodiment of the present invention. The embodiment of FIG. 7 is an alternate embodiment to various other embodiments described herein, including the alignment fixture of FIG. 4. Here, in FIG. 7, a top chilling plate 710 and a bottom chilling plate 714 are secured to one another via a securing mechanism 718. This securing mechanism may operate as a hinge such that the top chilling plate 710 can be moved toward the bottom chilling plate 714, and therefore closed, having other components in between, such as the alignment frame 720 (e.g., alignment plate) shown here. Each of the top chilling plate 710 and the bottom chilling plate 714 has a raised portion, raised portion 712 and raised portion 716, that, in one embodiment, are shaped similar to the portion of the shoe being cold pressed. In FIG. 7, a vamp portion of a shoe is being cold pressed using the system shown. The alignment frame 720 has a cut out portion, or framed middle portion 722 that is also substantially in the shape of the shoe portion being cold pressed.

As shown in FIG. 7, the alignment frame 720 contains a plurality of holes. The holes that are lined up around the framed middle portion 722, in one embodiment, may be threaded holes. Pins that have notches on them that correspond to these holes may be used to secure a shoe portion into place. The pins are inserted into these holes. In some embodiments, only a portion of the holes are used at one time. The number of pins and corresponding holes that are used may depend on the type of component or the type of machine that is performing a specific process on the shoe component. Having as many holes as shown in FIG. 7 allows for maximum flexibility of the alignment frame 720 such that it can be used with a variety of machines and processes. The larger and more sparse holes shown in FIG. 7 allow for each plate or component shown here, in addition to others that may not be shown, to be secured to one another. Additionally, the small and large slots on the alignment frame 720, shown generally as reference number 724, may allow the alignment gauge, or more specifically the alignment frame 720 to be secured to various pieces of manufacturing equipment, including, without limitation, a printer, a heat press, an embroidery machine, a forming machine, a trimming machine, etc.

Figure 8:
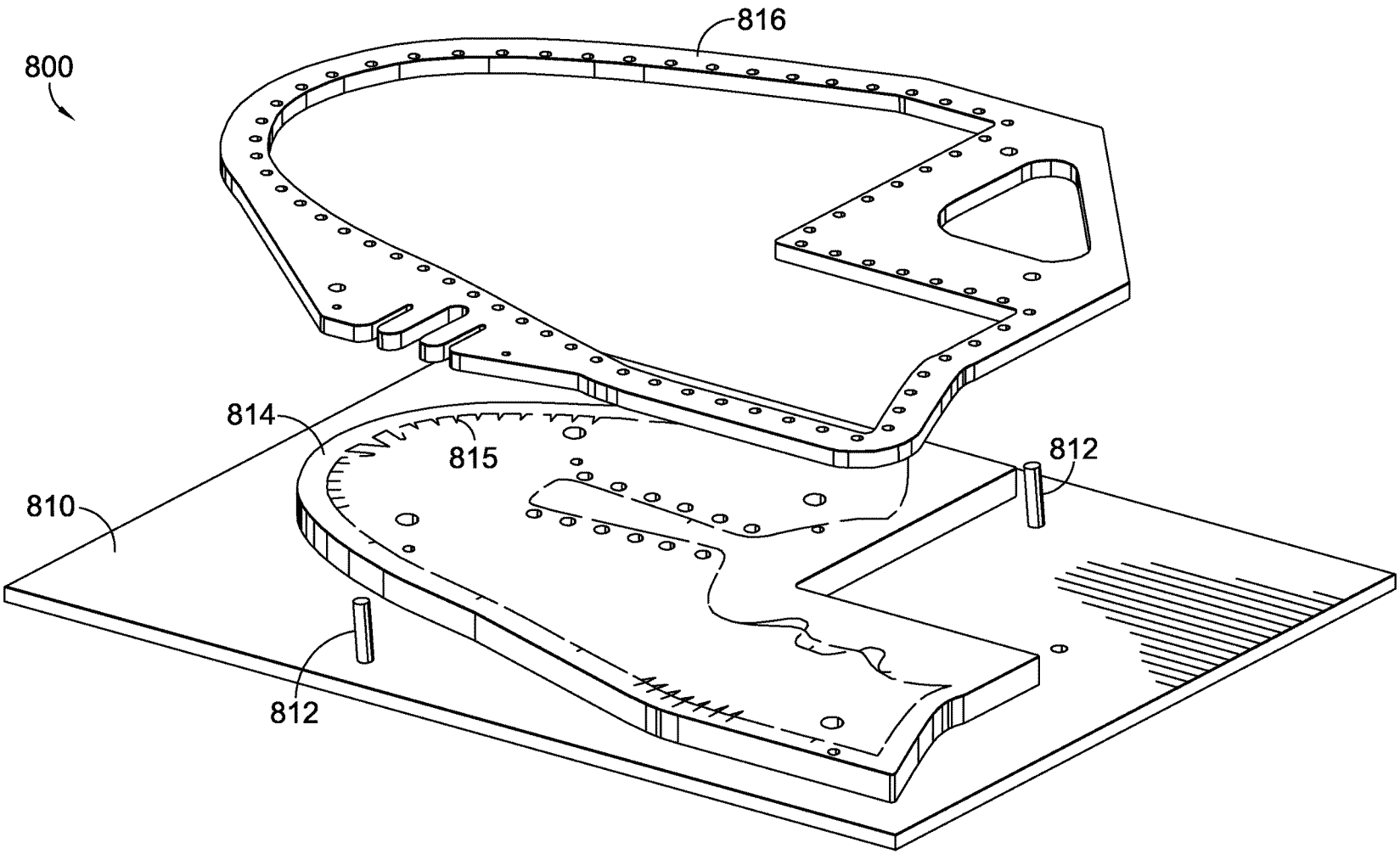
FIG. 8 illustrates an alignment fixture used to perform final trimming on a vamp portion of a shoe, in accordance with an embodiment of the present invention.

FIG. 8 illustrates an alignment fixture 800 used to perform final trimming on a vamp portion of a shoe, in accordance with an embodiment of the present invention. Base plate 810 includes a raised portion 814 and two pins 812. The pins 812 are used to secure the base plate 810 to the alignment frame 816, as the pins 812 correspond to openings or holes in the alignment frame 816. Further, the raised portion 814 includes various ridges, shown generally as reference number 815. These various shaped ridges 815 may have blades within them that protrude upward from the raised portion 814 such that when the alignment frame 816 is secured to the base plate 810, the blades in the ridges 815 cut through the shoe portion and thus trim the shoe portion to the correct shape. Other holes shown on the raised portion 814 allow for other plates, not shown here, to be secured to the base plate 810.

Figure 9:
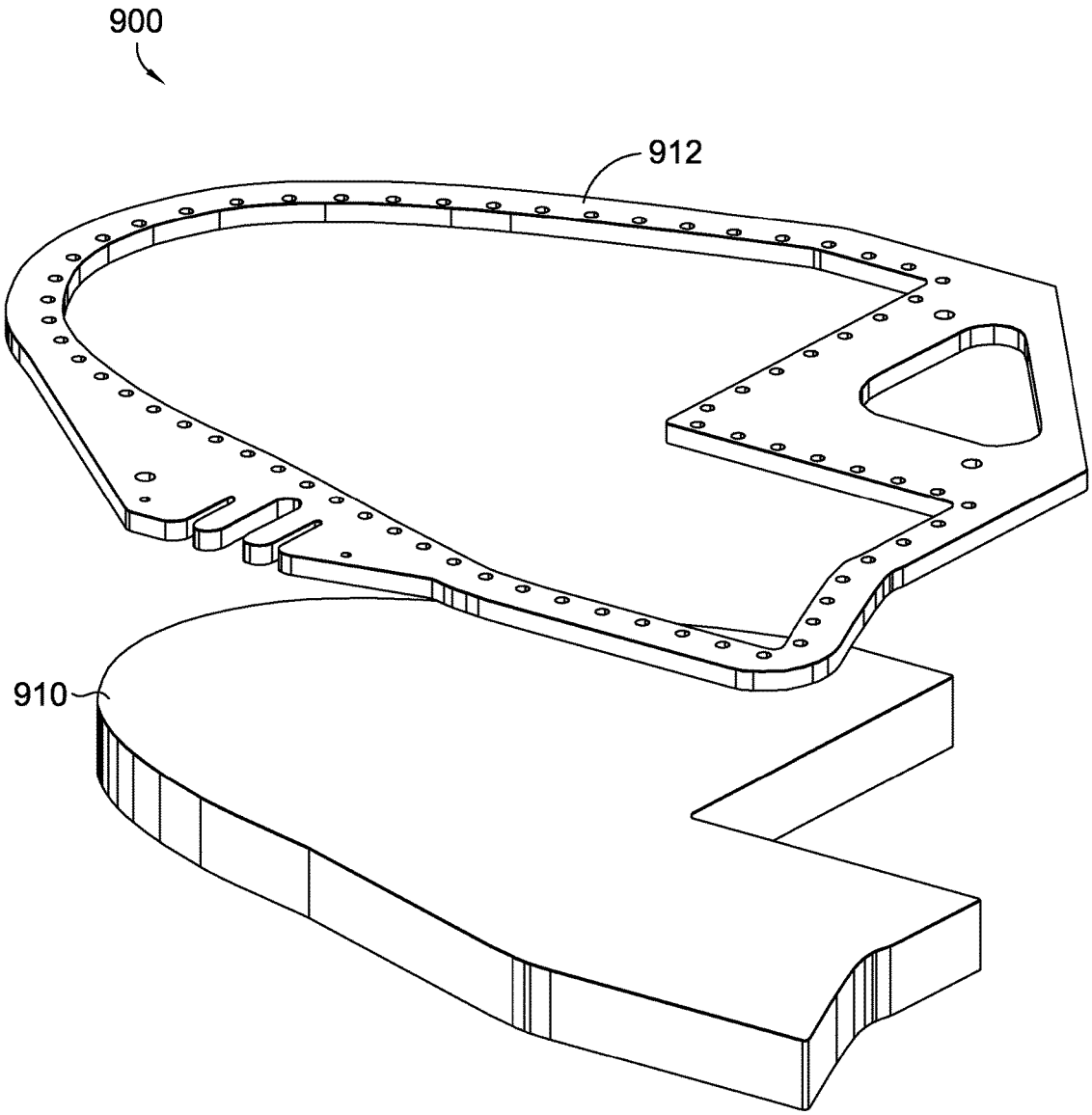
FIG. 9 illustrates an alignment fixture used to form a vamp portion of a shoe, in accordance with an embodiment of the present invention.

Referring to FIG. 9, an alignment fixture 900 used to form a vamp portion of a shoe is illustrated, in accordance with an embodiment of the present invention. This forming system includes a base plate 910 and an alignment plate 912. The base plate 910 may be formed of, in one embodiment, aluminum Teflon coated dies or plates, whose shape may be dictated by the type of the shoe portion being used in conjunction with the forming system shown in FIG. 9. Here, the shoe portion may be a vamp. The alignment frame 912 is similar, or even the same as that shown in FIGS. 7-8. For example, the alignment frame 912 includes a cut out or framed middle portion that is substantially the same shape as the shoe portion, and the same shape as the shape of the bottom plate 910. Further, the alignment frame 912 includes a plurality of small holes and various larger holes used to secure the alignment frame 912 to various tools and machines. In one embodiment, a top plate, not shown here, may be used to sandwich the alignment frame 912 such that the alignment frame 912, and thus the shoe portion are located and pressed in between the base plate 910 and the top plate.

Figure 10:
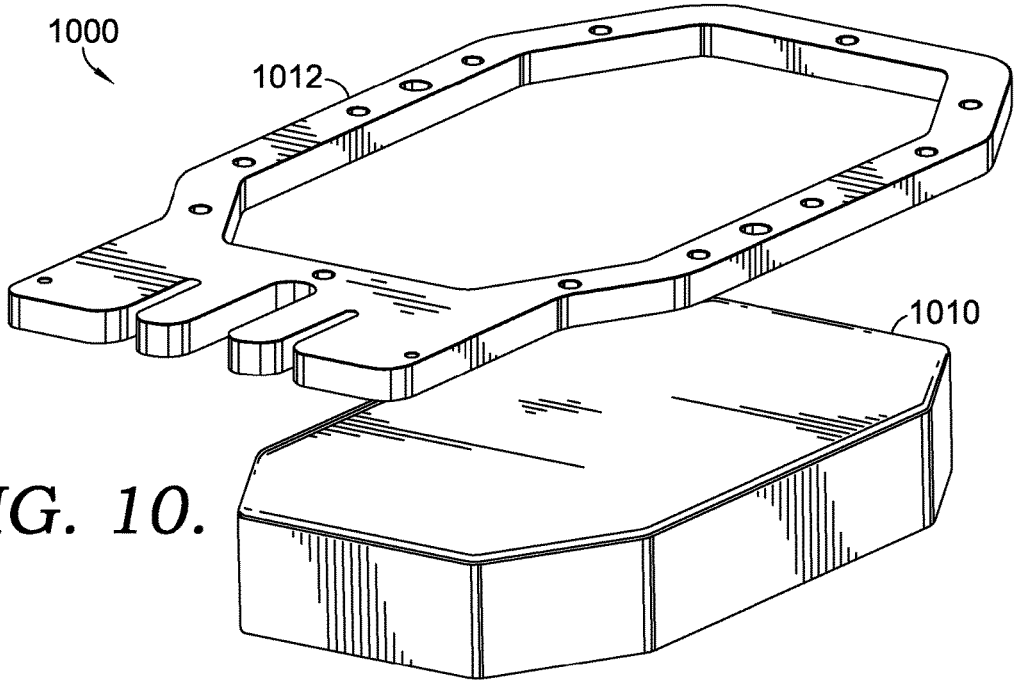
FIG. 10 illustrates an alignment fixture used to form a tongue portion of a shoe, in accordance with an embodiment of the present invention.

FIG. 10 illustrates an alignment fixture 1000 used to form a tongue portion of a shoe, in accordance with an embodiment of the present invention. FIG. 10 includes a base plate 1010 and an alignment frame 1012. These components function in the same way as those described herein in relation to FIG. 9. Here, the difference is that the shoe portion is a tongue of a shoe instead of a vamp. The alignment frame 1012 has a plurality of small and larger holes used to secure the shoe portion to the alignment frame 1012, and to secure the alignment frame 1012 to other components not shown here.

Figure 11:
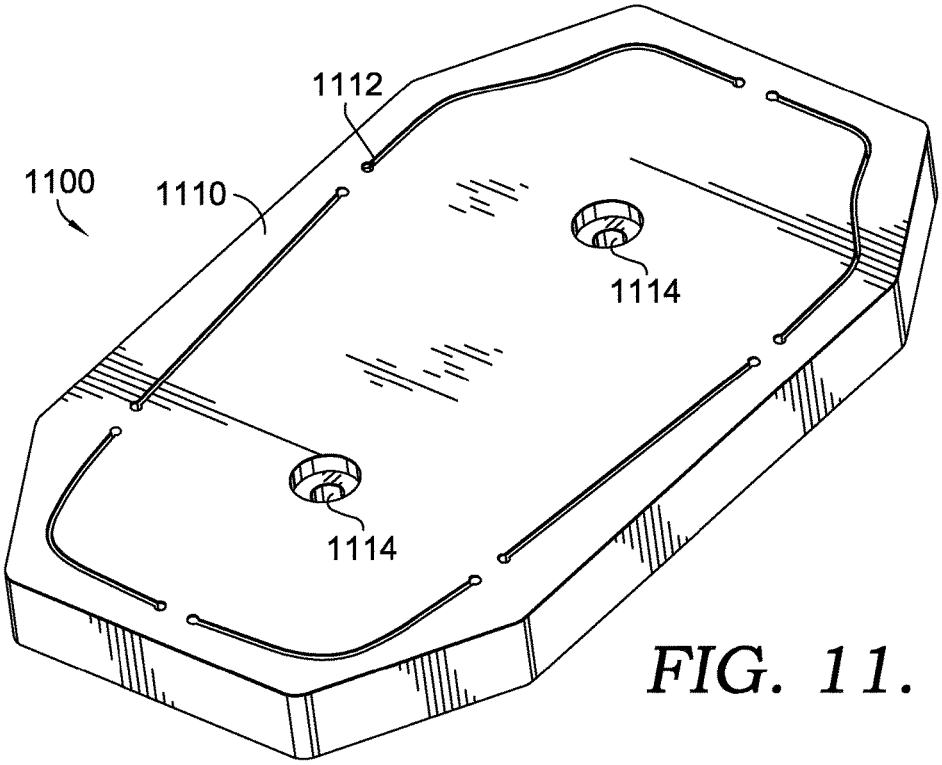
FIG. 11 illustrates a tongue trimming system, in accordance with an embodiment of the present invention.

FIG. 11 illustrates a tongue trimming system 1100, in accordance with an embodiment of the present invention. The tongue trimming system 1100 includes a trimming plate 1110 having various ridges that allow for blades to be inserted that cut through the shoe portion being trimmed. The two holes 1114 on the trimming plate 1110 allow for another plate, not shown, to be mounted to the trimming plate 1110.

Figure 12:
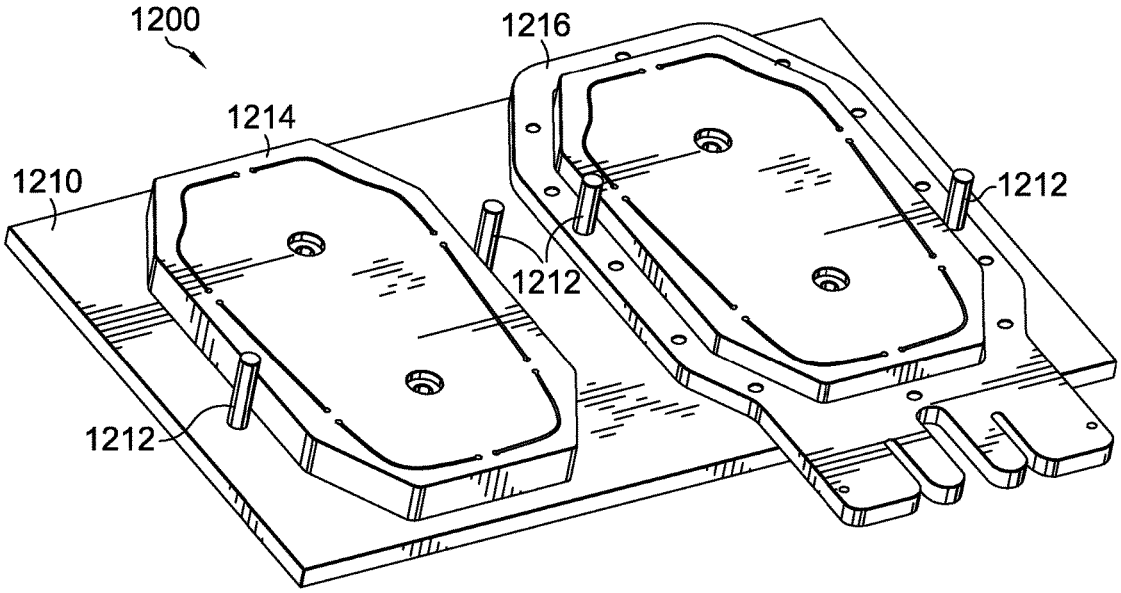
FIG. 12 illustrates a tongue trimming system for a left and a right shoe, in accordance with an embodiment of the present invention.

FIG. 12 illustrates a tongue trimming system 1200 for a left and a right shoe, in accordance with an embodiment of the present invention. The tongue trimming system 1200 includes the trimming plate 1110 described in FIG. 11. Here, there are two stations for performing trimming. One may be for a left shoe or a portion of a left shoe, and the other may be for a portion of a right shoe. Here, the portion is a tongue. Base plate 1210 is secured to the two trimming plates 1214 and 1216 by, in one embodiment, the two large holes in each trimming plate which allow for a pin, for example, to protrude through the holes, thus securing the trimming plates 1214 and 1216 in place. The base plate 1210 also has a plurality of pins 1212 that may be used to secure a top plate, not shown, to the rest of the alignment fixture. The top plate may be used for other processes other than trimming.

Figure 13:
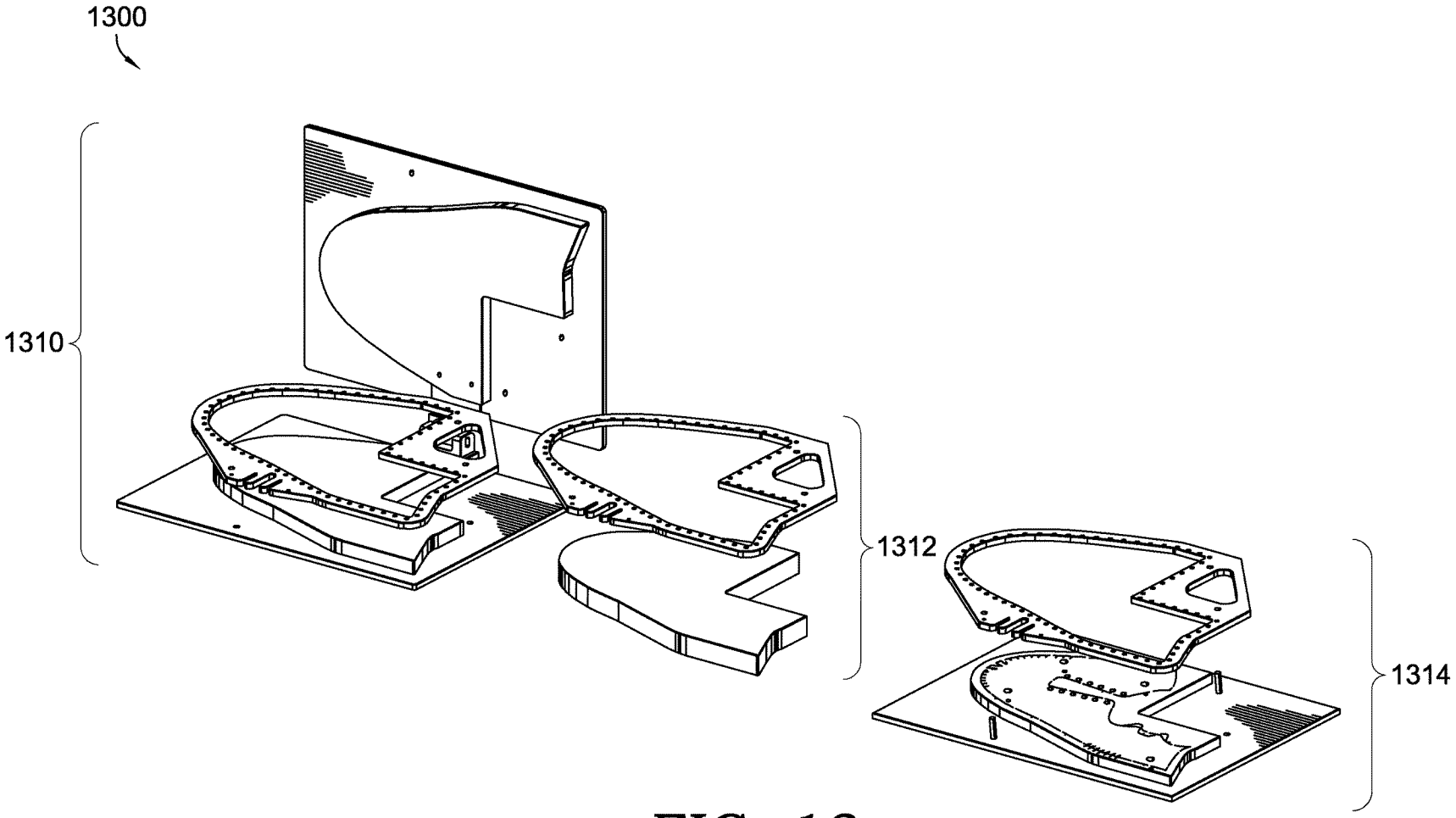
FIG. 13 illustrates a series of processes, including cold pressing, forming, and trimming of a vamp portion of a shoe, in accordance with an embodiment of the present invention.

FIG. 13 illustrates a series of processes used in conjunction with an alignment fixture, the processes shown generally as reference number 1300. These processes include cold pressing, forming, and trimming of a vamp portion of a shoe, in accordance with an embodiment of the present invention. Each of processes 1310, 1312, and 1314 have been described herein, but are shown here in FIG. 13 as a series of processes. It should be noted that the same alignment frame is used in each of the processes, and is easily placed and removed from each process.

While the present invention has been described in relation to the customization and manufacturing of a shoe, it will be appreciated that the present invention may also be used in conjunction with other products that may be produced from fabric or other materials and that may be customized in certain aspects. For example, various aspects of the present invention may be used in the customization and manufacture of handbags, sports equipment (e.g., soccer balls, sports bags), or any type of clothing, including hats.

The present invention has been described in relation to particular embodiments, which are intended in all respects to be illustrative rather than restrictive. Alternative embodiments will become apparent to those of ordinary skill in the art to which the present invention pertains without departing from its scope. For example, the inventions described herein may be readily applied to manufacturing any type of footwear including dress shoes, sandals, all types of boots, or any other type of footwear. Furthermore, aspects hereof may be readily adapted to any traditional manufacturing process where reducing variation due to operator interaction is desired.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

The invention claimed is:

1. An alignment fixture for use during a shoe manufacturing process, the alignment fixture comprising:

a first portion;

a second portion; and a securing mechanism comprising an alignment mating member configured to secure the alignment fixture to an alignment mounting member located at a piece of manufacturing equipment;

wherein the alignment fixture is configured to secure a portion of a shoe between the first portion and the second portion of the alignment fixture so that the shoe portion remains flat and fixed in place in relation to the first portion and the second portion of the alignment fixture, while various processes are performed on the shoe portion to thereby reduce manufacturing variation from shoe to shoe.

2. The alignment fixture of claim 1, wherein the first portion comprises a first cutout area having one or more notches, wherein the second portion comprises a second cutout area that corresponds with the first portion and one or more pins configured to be received into the one or more notches of the first cutout area.

3. The alignment fixture of claim 1, further comprising a third portion that is secured to the first and second portions, wherein the third portion includes at least one raised area.

4. The alignment fixture of claim 3, wherein the third portion further includes one or more recessed areas configured to receive various materials to be included in the shoe portion.

5. The alignment fixture of claim 1, wherein the alignment mounting member comprises one or more pins configured to engage with the alignment mating member of the securing mechanism.

6. The alignment fixture of claim 2, wherein the first cutout area and the second cutout area are configured to have a similar shape with the shoe portion.

7. The alignment fixture of claim 3, wherein the at least one raised area is configured to have a similar shape with the shoe portion.

8. The alignment fixture of claim 1, wherein the first portion and the second portion are secured to each other by way of one or more hinges.

9. The alignment fixture of claim 5, wherein the alignment mating member comprises one or more slots configured to receive the one or more pins of the alignment mounting member, and wherein the piece of manufacturing equipment comprises one or more of a printer, a laser machine, an embroidery machine, a forming machine, a sewing machine, and a cutting machine.

* * * * *